US009597878B2

(12) United States Patent
Takahashi

(10) Patent No.: US 9,597,878 B2
(45) Date of Patent: Mar. 21, 2017

(54) INKJET RECORDING APPARATUS

(71) Applicant: KYOCERA Document Solutions Inc., Osaka (JP)

(72) Inventor: So Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/887,807

(22) Filed: Oct. 20, 2015

(65) Prior Publication Data

US 2016/0114586 A1 Apr. 28, 2016

(30) Foreign Application Priority Data

Oct. 27, 2014 (JP) ..... 2014-218407
Mar. 12, 2015 (JP) ..... 2015-049366

(51) Int. Cl.
*B41J 2/165* (2006.01)

(52) U.S. Cl.
CPC ..... *B41J 2/16538* (2013.01); *B41J 2/16544* (2013.01)

(58) Field of Classification Search
CPC ..... B41J 2/16523; B41J 2/16552
See application file for complete search history.

(56) References Cited

U.S. PATENT DOCUMENTS

2005/0062796 A1* 3/2005 Mott ..... B41J 2/16535 347/33

FOREIGN PATENT DOCUMENTS

| | | | |
|---|---|---|---|
| JP | H0-437555 | A | 2/1992 |
| JP | 2001-071513 | A | 3/2001 |
| JP | 2012-040828 | A | 3/2012 |

OTHER PUBLICATIONS

An Office Action issued by the Japanese Patent Office on Aug. 23, 2016, which corresponds to Japanese Patent Application No. 2014-218407 and is related to U.S. Appl. No. 14/887,807.

* cited by examiner

*Primary Examiner* — Jason Uhlenhake
(74) *Attorney, Agent, or Firm* — Studebaker & Brackett PC

(57) ABSTRACT

An inkjet recording apparatus includes a recording head that has an ink discharge surface and that discharges ink onto a recording medium, a wiper blade that cleans the ink discharge surface of the recording head, and a controller. The controller causes the wiper blade to wipe ink off the ink discharge surface by causing the wiper blade to be pushed against the ink discharge surface and move in a predetermined movement direction. The wiper blade includes a protrusion protruding in the predetermined movement direction. The protrusion has an ink retaining surface that faces the ink discharge surface at a predetermined distance while the wiper blade wipes ink off the ink discharge surface.

19 Claims, 13 Drawing Sheets

INKJET RECORDING APPARATUS

INCORPORATION BY REFERENCE

The present application claims priority under 35 U.S.C. §119 to Japanese Patent Applications No. 2014-218407, filed on Oct. 27, 2014, and No. 2015-049366, filed on Mar. 12, 2015. The contents of these applications are incorporated herein by reference in their entirety.

BACKGROUND

The present disclosure relates to inkjet recording apparatuses.

A certain inkjet recording apparatus includes a wiper blade for cleaning an ink discharge surface of a recording head. The ink discharge surface is a surface where nozzles that discharge ink are disposed. The inkjet recording apparatus moves the wiper blade while pushing the wiper blade against the ink discharge surface, thereby wiping ink attached to the ink discharge surface.

For example, the wiper blade of the inkjet recording apparatus includes a ribbed member on a tip end thereof. As such, even in a configuration in which the ink discharge surface of the inkjet recording apparatus has a recess, responsive movement of the tip end part of the wiper blade in accordance with the shape of the recess can be ensured and wiping performance can be secured.

Incidentally, ink that has been discharged from the recording head increases in viscosity (is thickened) over time due to evaporation of a volatile component contained therein. The thickened ink discharged from the recording head and remaining on the ink discharge surface (hereinafter referred to as residual ink) may be hard to be removed through simple application of physical force by movement of the wiper blade. Thickened ink decreases in viscosity when mixed with non-thickened fresh ink (hereinafter referred to as fresh ink).

In view of the foregoing, a method has been adopted in which wiping is performed once fresh ink is released onto the ink discharge surface in order to cleanly remove residual ink attached to the ink discharge surface. In the above method, the residual ink is mixed with the fresh ink before or during wiping to decrease its viscosity, so that the inkjet recording apparatus can cleanly remove the residual ink.

SUMMARY

An inkjet recording apparatus according to an aspect of the present disclosure includes a recording head having an ink discharge surface and configured to discharge ink onto a recording medium, a wiper blade configured to clean the ink discharge surface of the recording head, and a controller. The controller is configured to cause the wiper blade to wipe ink off the ink discharge surface by causing the wiper blade to be pushed against the ink discharge surface and move in a predetermined movement direction. The wiper blade includes a protrusion protruding in the predetermined movement direction. The protrusion has an ink retaining surface that faces the ink discharge surface at a predetermined distance while the wiper blade wipes ink off the ink discharge surface.

DETAILED DESCRIPTION

Figure 1:
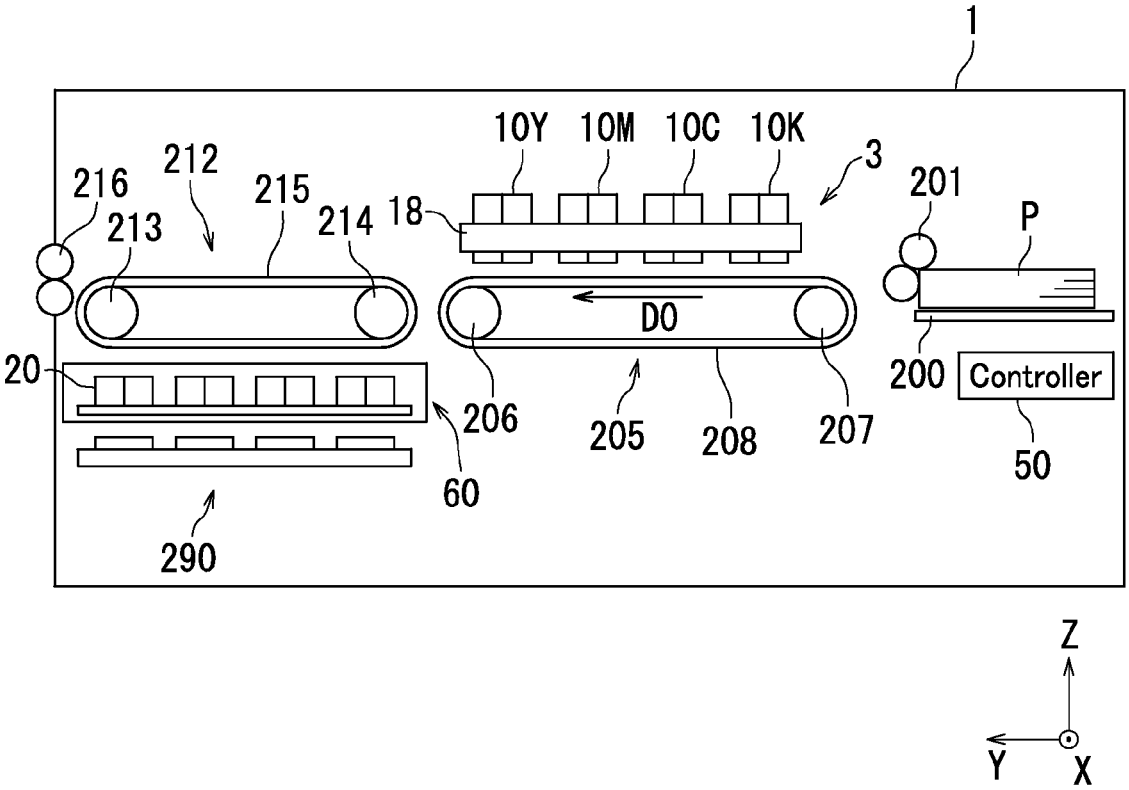
FIG. 1 is a diagram illustrating a configuration of an inkjet recording apparatus according to a first embodiment.

Embodiments of the present disclosure will be described below with reference to the accompanying drawings. Note that the embodiments described below are not intended to limit the disclosure of the appended claims. Also note that not all of the elements described in the following embodiments are essential to achievement of the advantages of the present disclosure. Like reference signs denote like elements through the drawings. In the embodiments, X, Y, and Z axes in the drawings are perpendicular to one another. The X and Y axes are parallel to a horizontal plane, and the Z axis is parallel to a vertical line.

First Embodiment

A first embodiment will be described first with reference to FIGS. 1-7. FIG. 1 is a diagram illustrating a configuration of an inkjet recording apparatus 1 according to the first embodiment.

The inkjet recording apparatus 1 includes a tray 200, a feed roller 201, a first conveyance unit 205, a head portion 3, a second conveyance unit 212, an ejection roller 216, a wiper unit 60, a capping unit 290, and a controller 50.

Paper is placed on the tray 200 as a recording medium. The tray 200 is disposed upstream (on the right side in FIG.

1) of the first conveyance unit 205 in terms of a conveyance direction D0 of the paper P. The feed roller 201 is disposed at a downstream end of the tray 200 in terms of the conveyance direction D0. The feed roller 201 feeds the paper P placed on the tray 200 to the first conveyance unit 205 on a sheet-by-sheet basis.

A first conveyance belt 208 of the first conveyance unit 205 receives loading of the paper P fed from the feed roller 201 and conveys the paper P in the conveyance direction D0 (leftward in FIG. 1). The first conveyance unit 205 includes a first drive roller 206, a first driven roller 207, and the first conveyance belt 208. The first conveyance belt 208 is wound between the first drive roller 206 and the first driven roller 207. Upon a motor (not illustrated) driving to rotate the first drive roller 206, the first conveyance belt 208 is circulated, thereby conveying the paper P loaded on the first conveyance belt 208 in the conveyance direction D0.

Figure 2:
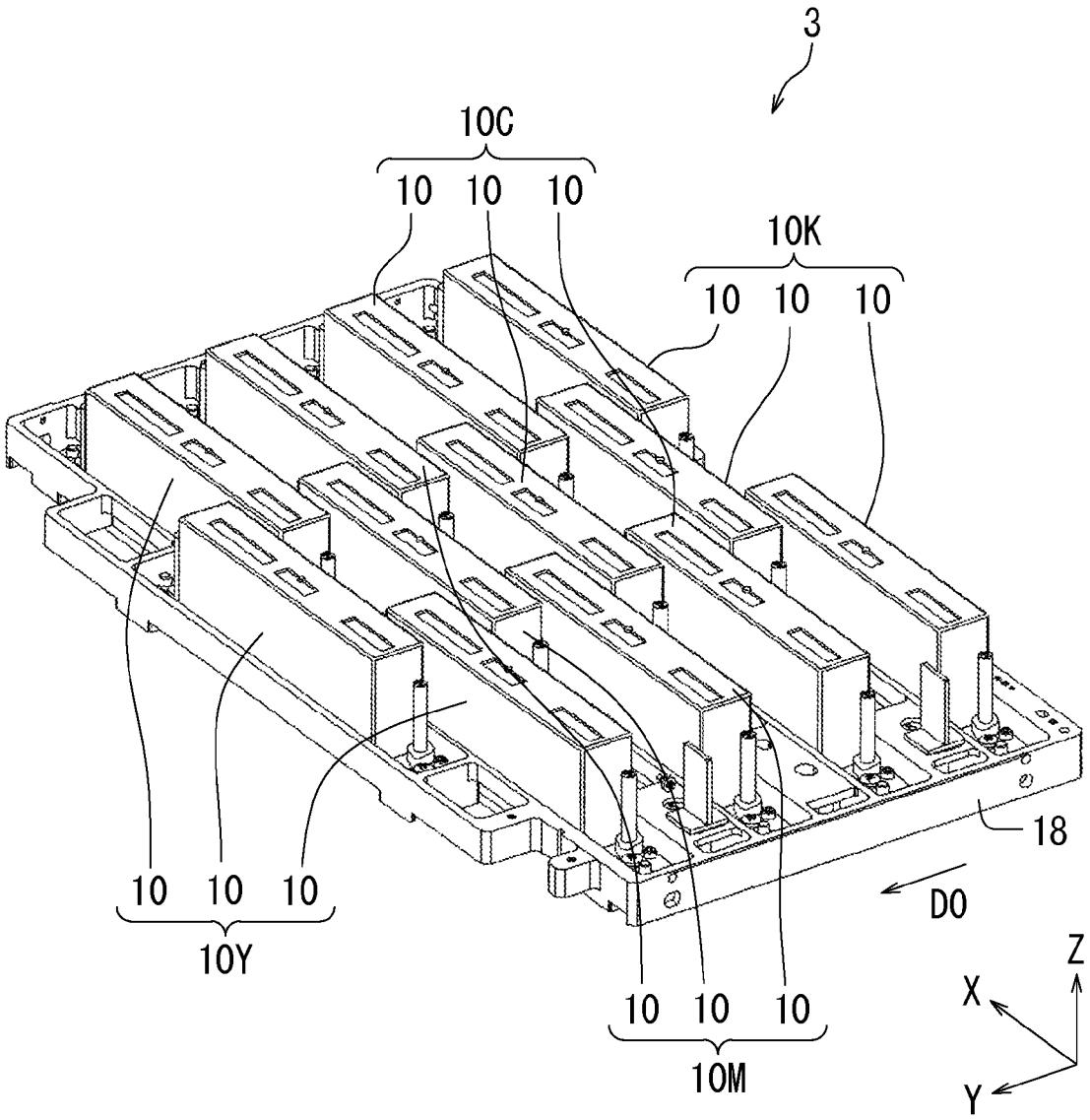
FIG. 2 is a perspective view of a head portion according to the first embodiment.
Figure 3:
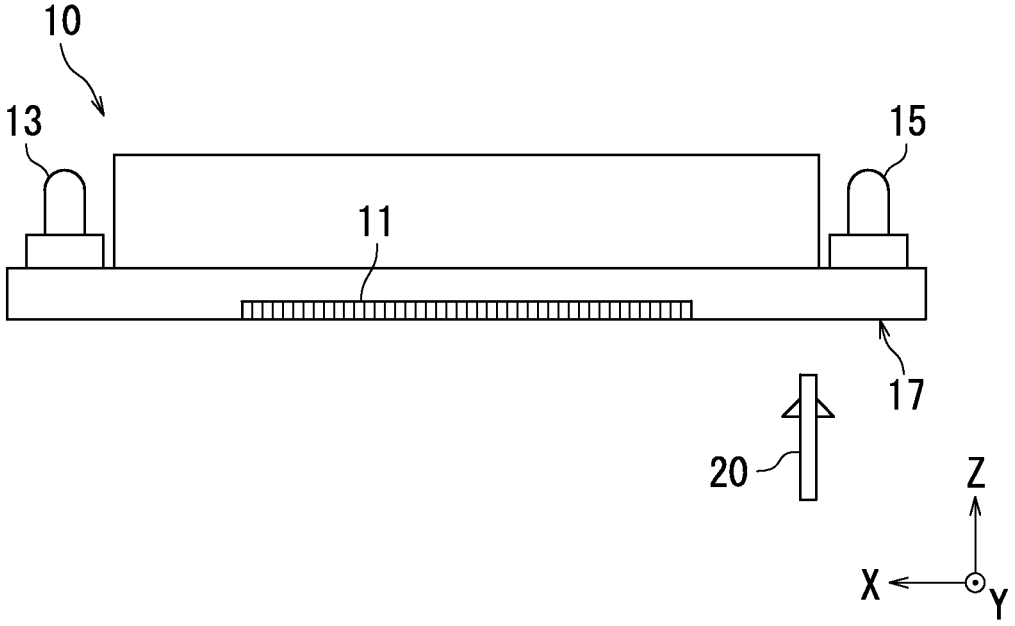
FIG. 3 is a side view of a recording head according to the first embodiment.

The head portion 3 is disposed opposite to the first conveyance unit 205. The head portion 3 discharges ink onto the paper P conveyed by the first conveyance unit 205 to form an image on the paper P. With reference to FIGS. 2 and 3, description will be made below about configurations of the head portion 3 and recording heads 10 included in the head portion 3.

FIG. 2 is a perspective view of the head portion 3 according to the first embodiment.

The head portion 3 includes a head housing 18 and different types (four types in the present embodiment) of line heads 10Y, 10M, 10C, and 10K. The line head 10Y is a line head for yellow color. The line head 10M is a line head for magenta color. The line head 10C is a line head for cyan color. The line head 10K is a line head for black color.

The plural types of line heads 10Y, 10M, 10C, and 10K are held by the head housing 18. The line heads 10Y, 10M, 10C, and 10K are arranged in the order of the line heads 10K, 10C, 10M, and 10Y from upstream to downstream in terms of the conveyance direction D0 of the paper P. In the present embodiment, the line heads 10Y, 10M, 10C, and 10K each include three recording heads 10 disposed in a staggered formation in a direction perpendicular to the conveyance direction D0 (an X axis direction in the present embodiment). The three recording heads 10 of the line head 10Y discharge yellow ink. The three recording heads 10 of the line head 10M discharge magenta ink. The three recording heads 10 of the line head 10C discharge cyan ink. The three recording heads 10 of the line head 10K discharge black ink.

FIG. 3 is a side view of a recording head 10 according to the first embodiment.

Each of the recording heads 10 includes a plurality of nozzles 11, an ink inlet 13, and an ink outlet 15. The recording head 10 has an ink discharge surface 17 where the nozzles 11 are disposed. The nozzles 11 are disposed in a central part of the ink discharge surface 17, for example. The nozzles 11 discharge ink for forming an image on the paper P. Further, the nozzles 11 release ink together with foreign matter within the recording head 10 for purging. Ink in an ink tank (not illustrated) flows into the recording head 10 through the ink inlet 13 and is then discharged in image formation or released in purging from the nozzles 11. The ink tank prevents evaporation of a volatile component contained in the ink. Accordingly, the ink discharged or released from the nozzles 11 is non-thickened fresh ink Nf (see FIG. 4).

Referring back to FIG. 1, the inkjet recording apparatus 1 will be described further. The second conveyance unit 212 is disposed downstream (on the left side in FIG. 1) of the first conveyance unit 205 in terms of the conveyance direction D0. The second conveyance unit 212 includes a second drive roller 213, a second driven roller 214, and a second conveyance belt 215. The second conveyance belt 215 is wound between the second drive roller 213 and the second driven roller 214. Upon a motor (not illustrated) driving to rotate the second drive roller 213, the second conveyance belt 215 is circulated, thereby conveying the paper P loaded on the second conveyance belt 215 in the conveyance direction D0.

The paper P on which the image is formed by the head portion 3 is fed to the second conveyance unit 212. During passing of the paper P through the second conveyance unit 212, ink attached to the surface of the paper P is dried. The ejection roller 216 ejects the paper P conveyed by the second conveyance unit 212 outside the inkjet recording apparatus 1.

The wiper unit 60 and the capping unit 290 are disposed below the second conveyance unit 212. The wiper unit 60 wipes ink attached to the ink discharge surface 17 of the recording head 10 using a wiper blade 20. To wipe ink attached to the ink discharge surface 17 means to clean the ink discharge surface 17. The capping unit 290 is fitted on the ink discharge surface 17 of the recording head 10 in a situation in which the recording head 10 is not used for a predetermined time period or longer. The above configuration can prevent ink in the recording head 10 from being dried. The configuration of the wiper unit 60 will be described later in detail with reference to FIG. 4.

The controller 50 controls operation of the entire inkjet recording apparatus 1. The controller 50 includes a central processing unit (CPU) and a memory. The memory stores therein various types of computer programs that are executed by the CPU. Functions of the controller 50 are implemented through execution of the various computer programs in the memory by the CPU.

For example, the controller 50 causes the wiper unit 60 to wipe the ink discharge surface 17. Specifically, the controller 50 causes the wiper blade 20 to be pushed against the ink discharge surface 17 and move in a predetermined movement direction, resulting in wiping of ink on the ink discharge surface 17 by the wiper blade 20. Note that the controller 50 causes the first conveyance unit 205 to descend before the wiper unit 60 wipes the ink discharge surface 17. The controller 50 then causes the wiper unit 60 to move horizontally to a standby position below the head portion 3 (a position between the head portion 3 and the first conveyance unit 205).

Before the ink discharge surface 17 of the recording head 10 is capped, the controller 50 for example causes the first conveyance unit 205 to descend. The controller 50 then causes the capping unit 290 to move horizontally below the head portion 3. The controller 50 then causes the capping unit 290 to move upward and be fitted on the ink discharge surface 17 of the recording head 10.

Figure 4:
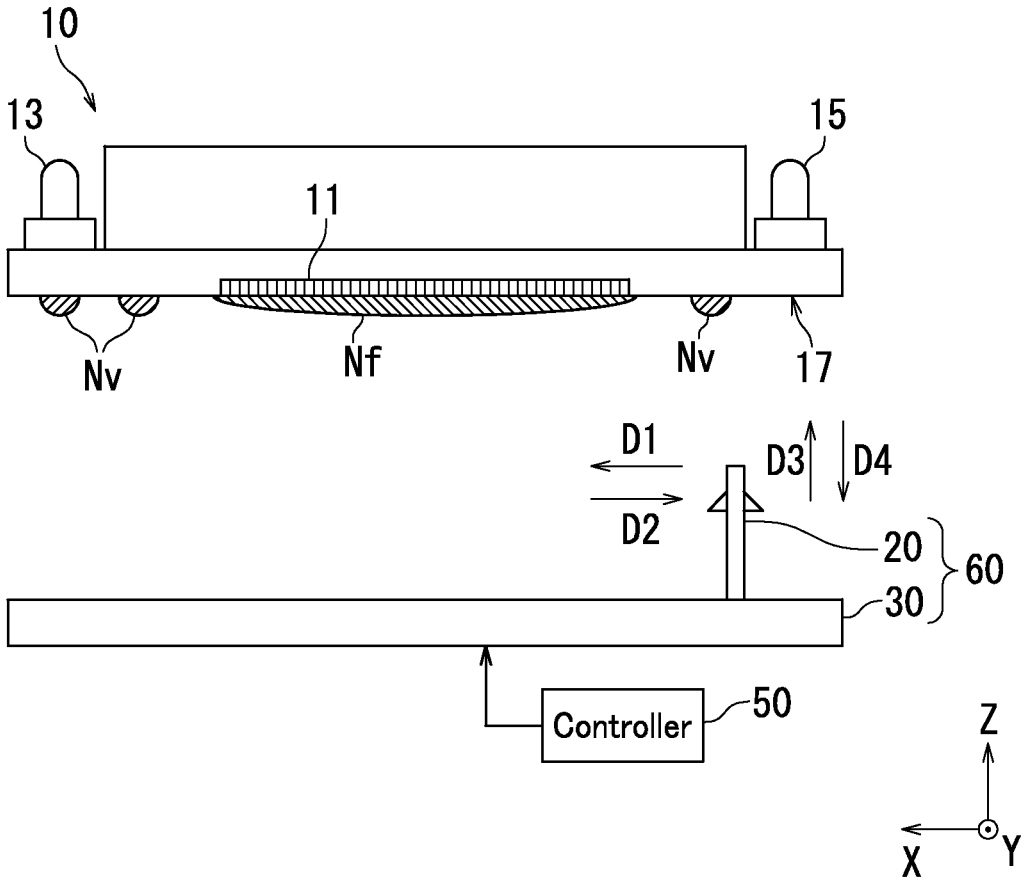
FIG. 4 is a diagram illustrating a configuration of a wiper unit according to the first embodiment.

FIG. 4 is a diagram illustrating a configuration of the wiper unit 60 according to the first embodiment.

The wiper unit 60 includes the wiper blade 20 and a movement mechanism 30. Only one wiper blade 20 is illustrated in FIG. 4 for the sake of convenience. However, the wiper unit 60 actually includes a plurality of wiper blades 20 each for one of the plurality of recording heads 10. The wiper blades 20 each wipe the ink discharge surface 17 of a corresponding one of the recording heads 10. The configuration of the wiper blade 20 will be described later in detail with reference to FIGS. 5-7.

The movement mechanism 30 moves the wiper blade 20 in accordance with an instruction from the controller 50. In the present embodiment, the movement mechanism 30 is capable of moving the wiper blade 20 in a first wiping direction D1 (a first movement direction), a second wiping direction D2 (a second movement direction), an ascending direction D3, and a descending direction D4. The first and second wiping directions D1 and D2 coincide with a direction of the X axis, that is, a direction along the ink discharge surface 17. The ascending direction D3 and the descending direction D4 opposite to the ascending direction D3 coincide with a direction of the Z axis. Hereinafter, the first and second wiping directions D1 and D2 may be referred to collectively as wiping directions.

For example, the controller 50 first causes the first conveyance unit 205 to descend in order for the wiper blade 20 to wipe the ink discharge surface 17. The controller 50 then causes the wiper unit 60 to move horizontally to the standby position below the head portion 3 (a location between the head portion 3 and the first conveyance unit 205). The controller 50 next causes the recording head 10 to release fresh ink Nf onto the ink discharge surface 17 for purging. The controller 50, by controlling the movement mechanism 30, causes the wiper blade 20 to move in the ascending direction D3 so that the wiper blade 20 is pushed against the ink discharge surface 17. Further, the controller 50, by controlling the movement mechanism 30, causes the wiper blade 20 to be pushed against the ink discharge surface 17 and to move in the first or second wiping direction D1 or D2. In this manner, the wiper blade 20 wipes ink, that is, residual ink Nv (first ink) and fresh ink Nf (second ink) off the ink discharge surface 17. The wiper blade 20 also wipes foreign matter (e.g., dust or dirt) attached to the ink discharge surface 17.

The residual ink Nv herein is ink that has remained on the ink discharge surface 17 and thickened after being discharged from the recording head 10. Therefore, the residual ink Nv may be hard to remove from the ink discharge surface 17 through simple application of physical force by movement of the moving wiper blade 20. When residual ink Nv is mixed with fresh ink Nf that is not thickened, the viscosity of the residual ink Nv decreases. Accordingly, the inkjet recording apparatus 1 releases fresh ink Nf onto the ink discharge surface 17 and then performs wiping to mix residual ink Nv with the fresh ink Nf. By doing so, the viscosity of the residual ink Nv can be decreased and the residual ink Nv can be cleanly removed from the ink discharge surface 17.

With reference to FIGS. 5A-7, description will be made next about a configuration of the wiper blade 20 according to the present embodiment.

Figure 5A:
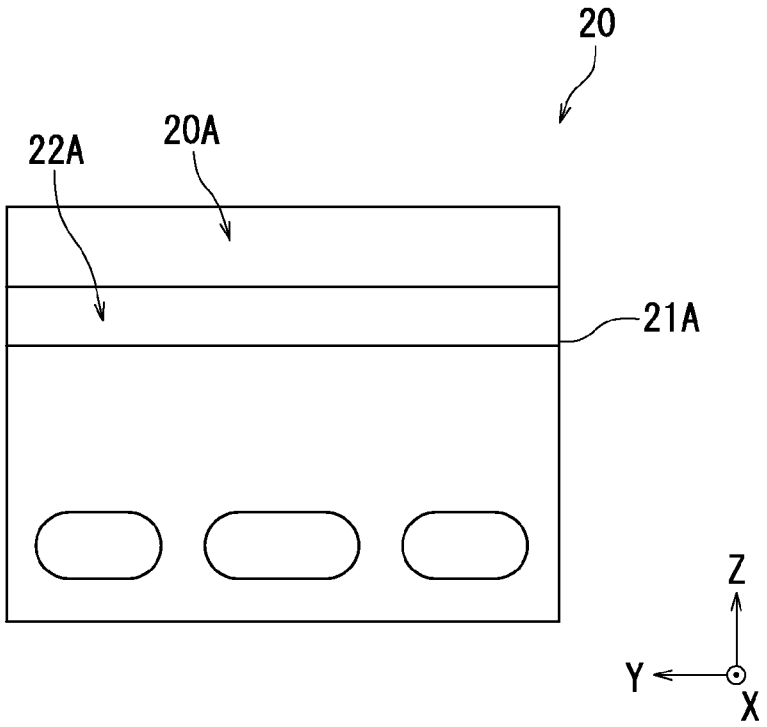
FIG. 5A is a front view of a wiper blade according to the first embodiment.
Figure 5B:
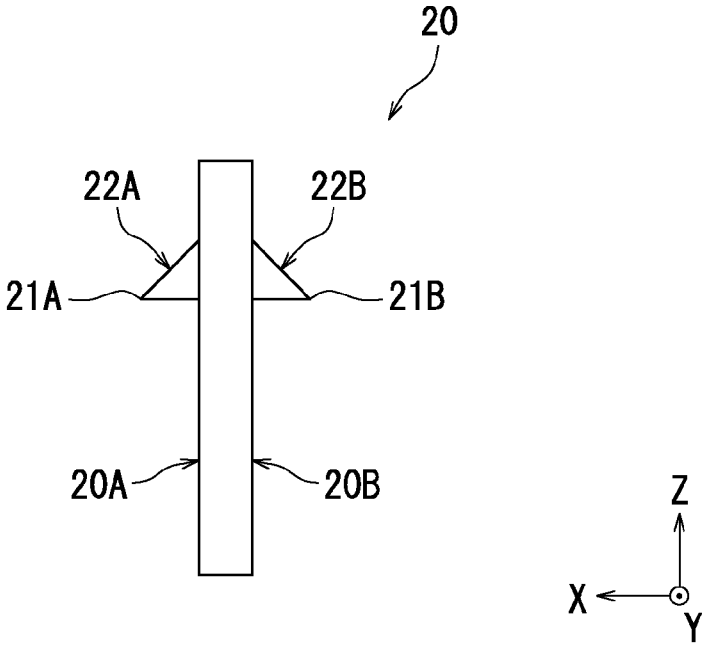
FIG. 5B is a side view of the wiper blade according to the first embodiment.
Figure 6:
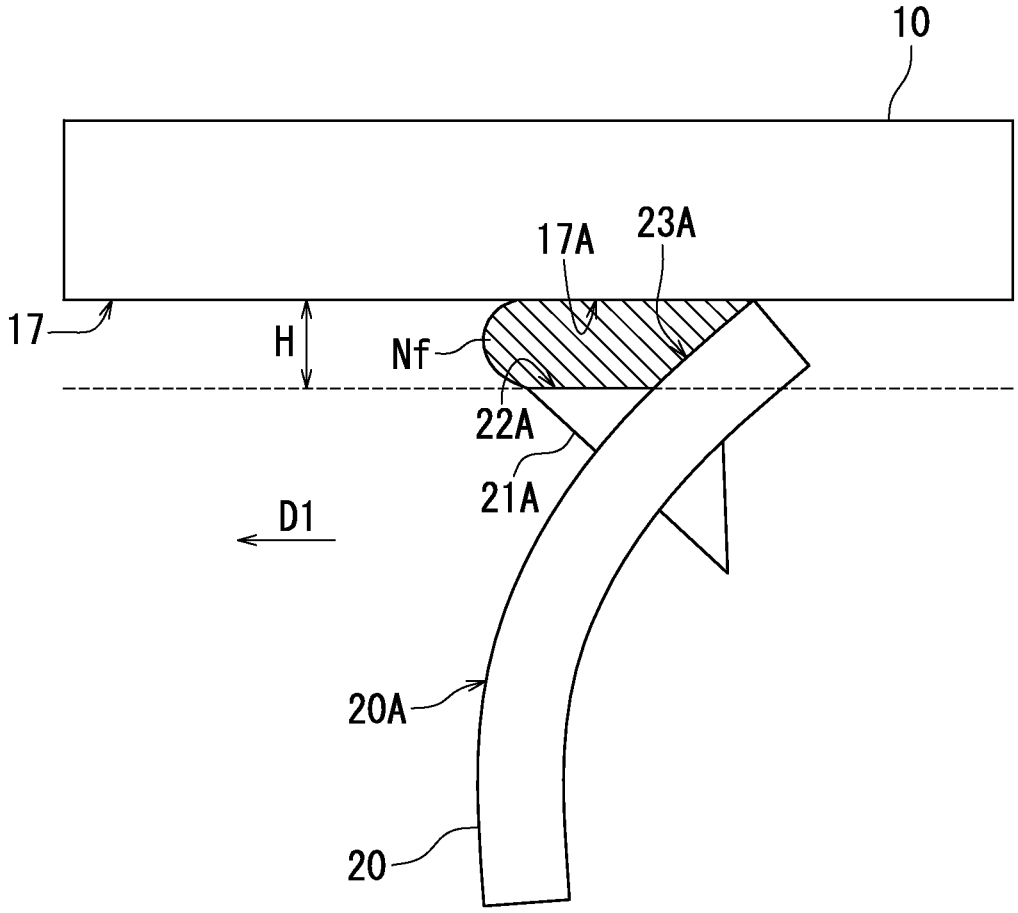
FIG. 6 is a diagram illustrating a shape of the wiper blade in wiping in a first wiping direction according to the first embodiment.
Figure 7:
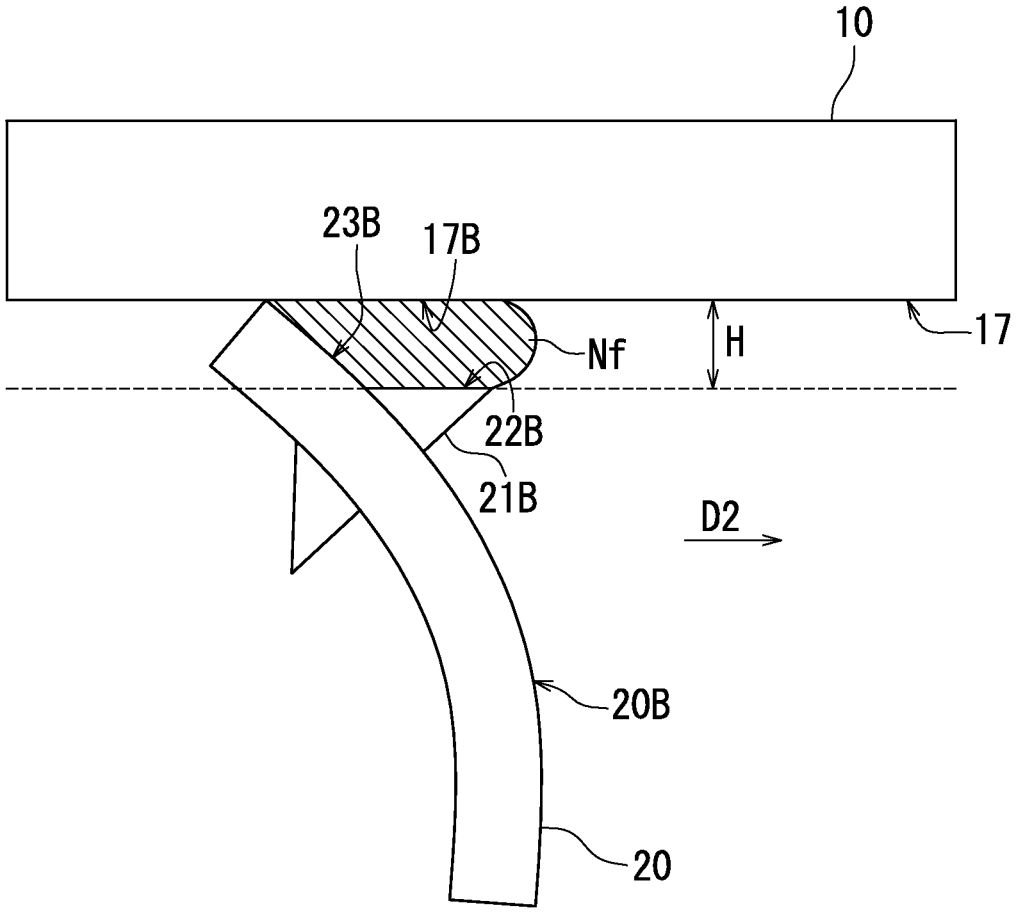
FIG. 7 is a diagram illustrating a shape of the wiper blade in wiping in a second wiping direction according to the first embodiment.

FIG. 5A is a front view of the wiper blade 20 according to the first embodiment. FIG. 5B is a side view of the wiper blade 20 according to the first embodiment. FIG. 6 is a diagram illustrating a shape of the wiper blade 20 in wiping in the first wiping direction D1. FIG. 7 is a diagram illustrating a shape of the wiper blade 20 in wiping in the second wiping direction D2.

As illustrated in FIGS. 5A and 5B, the wiper blade 20 is, for example, in a flat plate-like shape and has a flat upper end part (an end part that is pushed against the ink discharge surface 17). The wiper blade 20 may be an elastic member and, more specifically, may be made from, for example, synthetic rubber or synthetic resin. The wiper blade 20 in a state of wiping ink on the ink discharge surface 17 (hereinafter referred to as a wiping state) is pushed against the ink discharge surface 17 so as to be bent. Hereinafter, the wiping state in which the wiper blade 20 moves in the first wiping direction D1 is referred to as a first wiping state. Also, the wiping state in which the wiper blade 20 moves in the second wiping direction D2 is referred to as a second wiping state.

The back-and-forth direction where the wiper blade 20 is viewed from the front is a direction of the X axis, that is, a direction along the ink discharge surface 17. The wiper blade 20 has a front surface 20A (a first carrying surface) and a rear surface 20B (a second carrying surface) that are perpendicular to the wiping directions.

As illustrated in FIGS. 5A, 5B, and 6, the front surface 20A of the wiper blade 20 carries ink on the ink discharge surface 17 when the wiper blade 20 moves in the first wiping direction D1. In the present embodiment, the wiper blade 20 includes on the front surface 20A, a protrusion (hereinafter referred to as a front protrusion) 21A (a first protrusion) that protrudes in the first wiping direction D1. The front protrusion 21A is integral with the wiper blade 20, for example. The front protrusion 21A has a surface (a first ink retaining surface, hereinafter referred to as a front ink retaining surface 22A) connected to the front surface 20A in an inclined manner at a predetermined angle (e.g., 45 degrees) relative to the front surface 20A. The front ink retaining surface 22A faces the ink discharge surface 17 at a predetermined distance H in the first wiping state. The predetermined distance H may be equal across all regions of the front ink retaining surface 22A or differ in different regions of the front ink retaining surface 22A. In the present embodiment, the predetermined distance H is almost equal across all regions of the front ink retaining surface 22A. In other words, the front ink retaining surface 22A is substantially parallel to the ink discharge surface 17 in the first wiping state.

In the configuration as above, a pocket that can retain ink on the ink discharge surface 17, especially fresh ink Nf, is contoured in the first wiping state by the front ink retaining surface 22A, a region of the ink discharge surface 17 that faces the front ink retaining surface 22A (hereinafter referred to as a front confronting region 17A), and a partial region 23A of the front surface 20A. The partial region 23A of the front surface 20A herein is a region of the front surface 20A ranging from a point in contact with the ink discharge surface 17 to a point connected to the front ink retaining surface 22A. In the above configuration, the wiper blade 20 can carry more fresh ink Nf in wiping in the first wiping direction D1 than a configuration without the front ink retaining surface 22A. Note that the larger the area of the front ink retaining surface 22A is, the more fresh ink Nf the wiper blade 20 can carry.

The predetermined distance H is a distance, for example, within which ink on the front confronting region 17A, especially fresh ink Nf, comes into contact with the front ink retaining surface 22A. In other words, the predetermined distance H does not exceed a limit for height of a liquid column of fresh ink Nf formed due to surface tension (a liquid column formed between the front confronting region 17A and the front ink retaining surface 22A), beyond which the column of fresh ink Nf separates into ink on the front confronting region 17A and ink on the front ink retaining surface 22A. Hereinafter, the above height is referred to as a limit height.

The greater the predetermined distance H is, the greater the amount of fresh ink Nf the wiper blade 20 can carry. While on the other hand, when the predetermined distance H exceeds the limit height, advantages obtained by providing the front ink retaining surface 22A, that is, an increase in amount of carried fresh ink Nf may be hardly obtained. For this reason, the predetermined distance H is preferably determined to be proximate to the limit height. Note that the limit height depends on a material and the like of fresh ink Nf.

As illustrated in FIGS. 5A, 5B, and 7, the rear surface 20B of the wiper blade 20 carries ink on the ink discharge surface 17 when the wiper blade 20 moves in the second wiping direction D2. In the present embodiment, the wiper blade 20 includes on the rear surface 20B, a protrusion (a second protrusion, hereinafter referred to as a rear protrusion 21B) that protrudes in the second wiping direction D2. The rear protrusion 21B is integral with the wiper blade 20, for example. The rear protrusion 21B has a surface (a second ink retaining surface, hereinafter referred to as a rear ink retaining surface 22B) that is connected to the rear surface 20B in an inclined manner at a predetermined angle (e.g., 45 degrees) relative to the rear surface 20B. The rear ink retaining surface 22B faces the ink discharge surface 17 at a predetermined distance H in the second wiping state. The predetermined distance H may be equal across all regions of the rear ink retaining surface 22B or differ in different regions of the rear ink retaining surface 22B. In the present embodiment, the predetermined distance H is almost equal across all regions of the rear ink retaining surface 22B. In other words, the rear ink retaining surface 22B is substantially parallel to the ink discharge surface 17 in the second wiping state.

In the above configuration, a pocket that can retain ink on the ink discharge surface 17, especially fresh ink Nf, is contoured in the second wiping state by the rear ink retaining surface 22B, a region of the ink discharge surface 17 that faces the rear ink retaining surface 22B (hereinafter referred to as a rear confronting region 17B), and a partial region 23B of the rear surface 20B. The partial region 23B of the rear surface 20B herein is a region of the rear surface 20B ranging from a point in contact with the ink discharge surface 17 to a point connected to the rear ink retaining surface 22B. In the above configuration, the wiper blade 20 can carry more fresh ink Nf in wiping in the second wiping direction D2 than a configuration without the rear ink retaining surface 22B. Note that the larger the area of the rear ink retaining surface 22B is, the more fresh ink Nf the wiper blade 20 can carry.

Figure 8A:
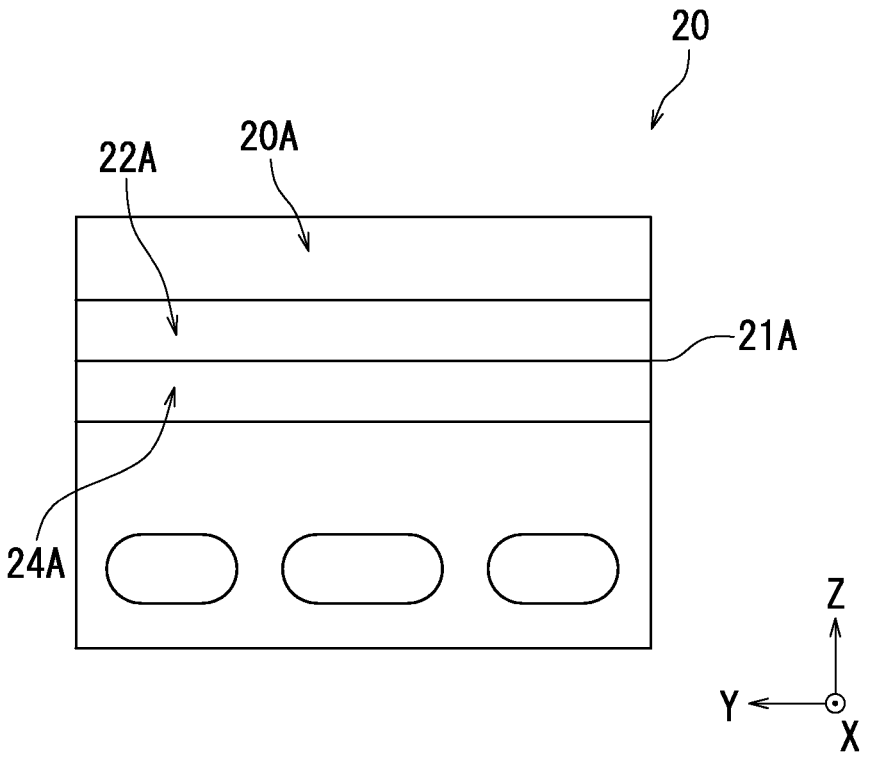
FIG. 8A is a front view of a wiper blade according to a variation of the first embodiment.
Figure 8B:
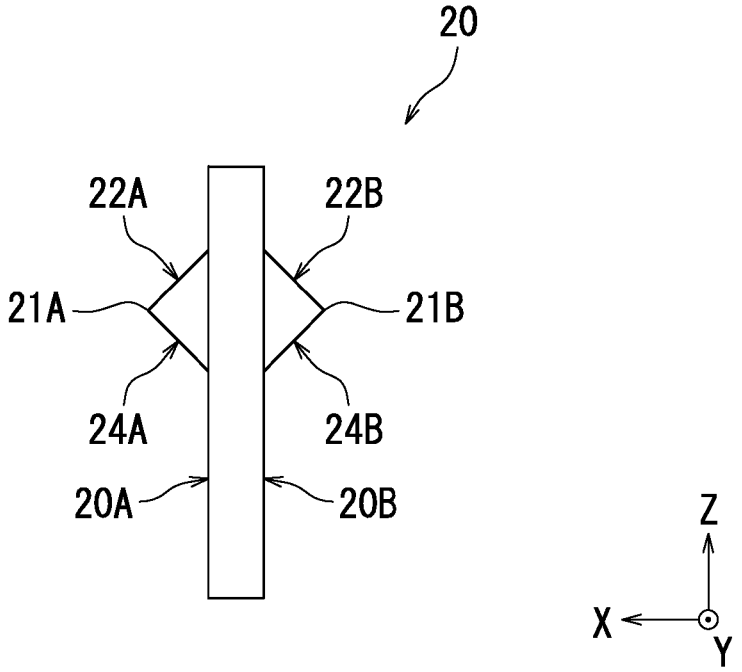
FIG. 8B is a side view of the wiper blade according to the variation of the first embodiment.

FIGS. 8A and 8B illustrate an example of a configuration of a wiper blade 20 according to a variation of the first embodiment. FIG. 8A is a front view of the wiper blade 20 according to the variation of the first embodiment. FIG. 8B is a side view of the wiper blade 20 according to the variation of the first embodiment.

A front protrusion 21A of the wiper blade 20 in the present variation has, in addition to a front ink retaining surface 22A, a surface (an ink releasing surface, hereinafter referred to as front ink releasing surface 24A) that is inclined at a predetermined angle (e.g., 45 degrees) relative to the front surface 20A and that is connected to the front surface 20A and the front ink retaining surface 22A (an end of a front ink retaining surface 22A on a protruding side). Similarly, a rear protrusion 21B of the wiper blade 20 according to the present variation has, in addition to a rear ink retaining surface 22B, a surface (an ink releasing surface, hereinafter referred to as a rear ink releasing surface 24B) that is inclined at a predetermined angle (e.g., 45 degrees) relative to the rear surface 20B and that is connected to the rear surface 20B and the rear ink retaining surface 22B (an end of the rear ink retaining surface 22B on a protruding side).

In the configuration with the front or rear ink releasing surface 24A or 24B, ink accumulated on the front or rear ink retaining surface 22A or 22B may tend to flow downward off the wiper blade 20 by flowing along the front or rear ink releasing surface 24A or 24B after wiping. Thus, a situation in which ink is accumulated on and adheres strongly to the front or rear ink retaining surface 22A or 22B can be prevented.

The wiper blade 20 in the present embodiment includes on the front surface 20A, the front protrusion 21A having the front ink retaining surface 22A. The front ink retaining surface 22A faces the ink discharge surface 17 at the predetermined distance H in the first wiping state. In the above configuration, the wiper blade 20 can carry more fresh ink Nf in wiping in the first wiping direction than a configuration without the front ink retaining surface 22A.

Further, the wiper blade 20 includes the rear protrusion 21B having the rear ink retaining surface 22B on the rear surface 20B. The rear ink retaining surface 22B faces the ink discharge surface 17 at the predetermined distance H in the second wiping state. In the above configuration, the wiper blade 20 can carry more fresh ink Nf in wiping in the second wiping direction D2 than a configuration without the rear ink retaining surface 22B.

Accordingly, in the inkjet recording apparatus 1 according to the present embodiment, even in a situation in which residual ink Nv is attached to a location apart from a region where fresh ink Nf is released (a central part where the plurality of nozzles 11 are disposed), a sufficient amount of fresh ink Nf can be carried to a location where the residual ink Nv is attached, thereby decreasing the viscosity of the residual ink Nv. Thus, the residual ink Nv can be cleanly removed from the ink discharge surface 17.

Second Embodiment

Figure 9:
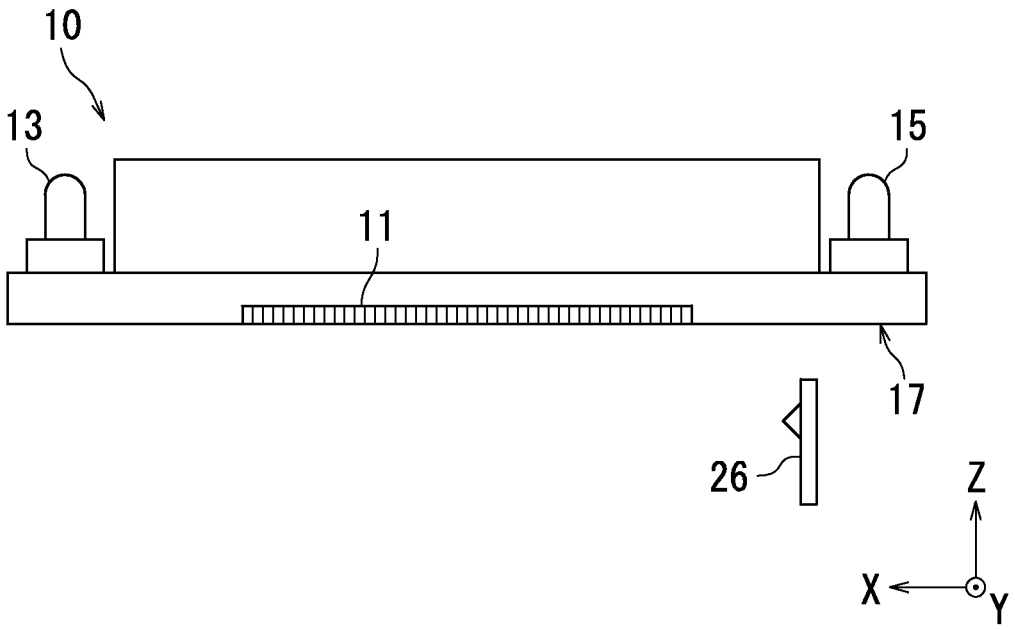
FIG. 9 is a side view of a recording head according to a second embodiment.

A second embodiment will be described next with reference to FIGS. 9-12B. FIG. 9 is a side view of a recording head 10 according to the second embodiment. Note that in the second embodiment and FIGS. 9-13C, like reference signs are assigned to elements corresponding to those in the first embodiment and description of such elements may be omitted.

The recording head 10 includes a plurality of nozzles 11, an ink inlet 13, and an ink outlet 15. The surface of the recording head 10 where the plurality of nozzles 11 are disposed is an ink discharge surface 17. The nozzles 11 are disposed at the central part of the ink discharge surface 17, for example. The nozzles 11 discharge ink for forming an image on paper P. Further, the nozzles 11 release ink together with foreign matter within the recording head 10 in purging. Ink to be discharged in image formation or released in purging by the nozzles 11 flows into the recording head 10 from an ink tank (not illustrated) via the ink inlet 13. The ink tank prevents evaporation of a volatile component contained in the ink. Accordingly, the ink discharged or released from the nozzles 11 is non-thickened fresh ink Nf (see FIG. 10).

A wiper blade 26 wipes ink attached to the ink discharge surface 17 of the recording head 10. To wipe ink attached to the ink discharge surface 17 is to clean the ink discharge surface 17.

Figure 10:
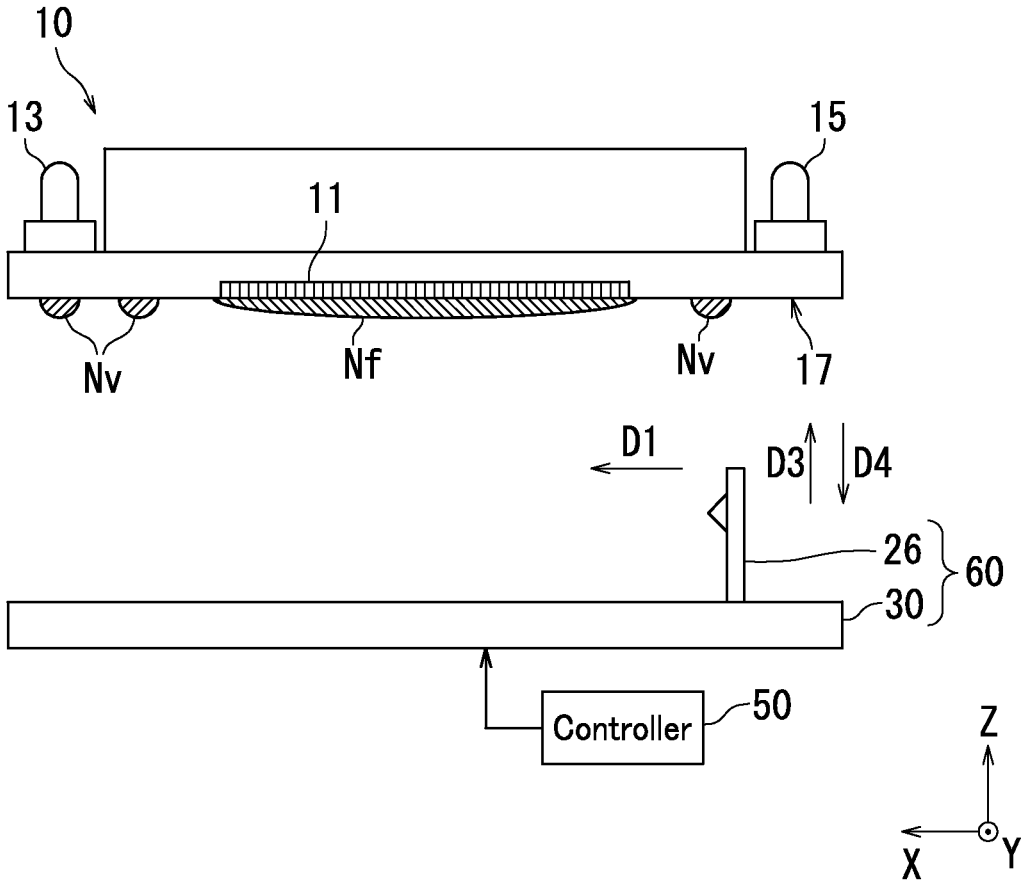
FIG. 10 is a diagram illustrating a configuration of a wiper unit according to the second embodiment.

FIG. 10 is a diagram illustrating a configuration of a wiper unit 60 according to the second embodiment.

The wiper unit 60 includes the wiper blade 26 and a movement mechanism 30. FIG. 10 illustrates only one wiper blade 26 for the convenience sake. However, the wiper unit 60 includes a plurality of wiper blades 26 each for one of the plurality of recording heads 10. The plurality of wiper blades 26 each wipe the ink discharge surface 17 of a corresponding one of the recording heads 10. The configuration of the wiper blade 26 will be described later with reference to FIGS. 11A-12B.

The movement mechanism 30 moves the wiper blade 26 in accordance with an instruction from a controller 50. The movement mechanism 30 in the second embodiment is capable of moving the wiper blade 26 in a first wiping direction D1, an ascending direction D3, and a descending direction D4.

For example, the controller 50 causes the recording head 10 to release fresh ink Nf onto the ink discharge surface 17 for purging. The controller 50 then controls the movement mechanism 30 to move the wiper blade 26 in the ascending direction D3 so that the wiper blade 26 is pushed against the ink discharge surface 17. The controller 50, by controlling the movement mechanism 30, causes the wiper blade 20 to be pushed against the ink discharge surface 17 and move in the first wiping direction D1. In this manner, the wiper blade 26 wipes ink, that is, residual ink Nv (first ink) and fresh ink Nf (second ink) off the ink discharge surface 17. The wiper blade 26 also wipes foreign matter (e.g., dust or dirt) attached to the ink discharge surface 17.

The residual ink Nv herein is ink discharged from the recording head 10 and remaining on the ink discharge surface 17 to be thickened. Therefore, the residual ink Nv may be hard to remove from the ink discharge surface 17 through simple application of physical force by movement of the moving wiper blade 26. When residual ink Nv is mixed with fresh ink Nf that is not thickened, the viscosity of the residual ink Nv decreases. Accordingly, the inkjet recording apparatus 1 releases fresh ink Nf onto the ink discharge surface 17 and then performs wiping to mix residual ink Nv with the fresh ink Nf. By doing so, the viscosity of the residual ink Nv can be decreased and the residual ink Nv can be cleanly removed from the ink discharge surface 17.

The configuration of the wiper blade 26 according to the second embodiment will be described next with reference to FIGS. 11A-12B.

Figure 11A:
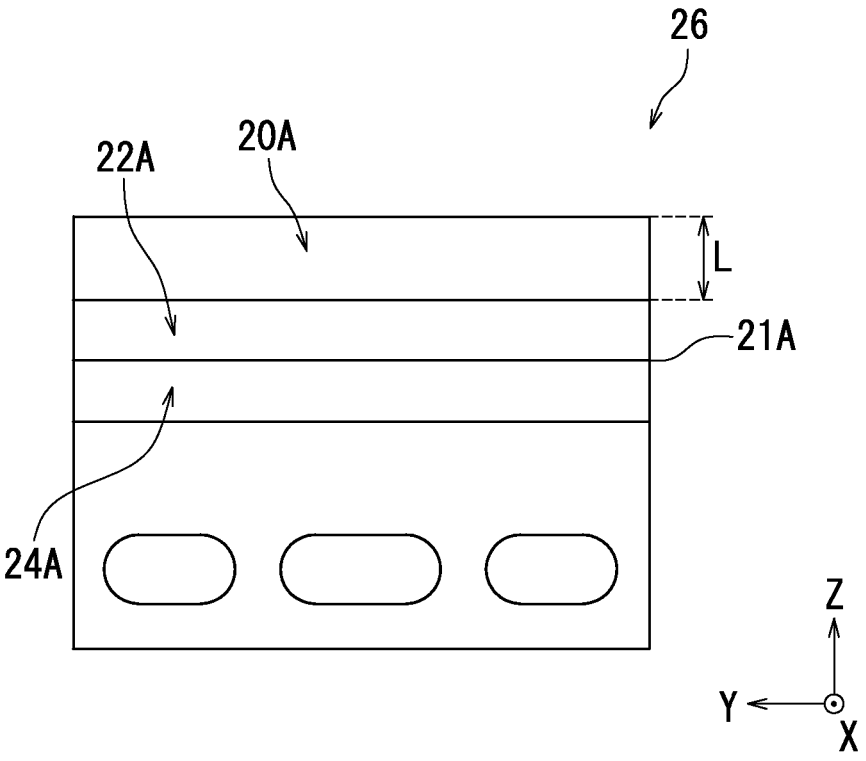
FIG. 11A is a front view of a wiper blade according to the second embodiment.
Figure 11B:
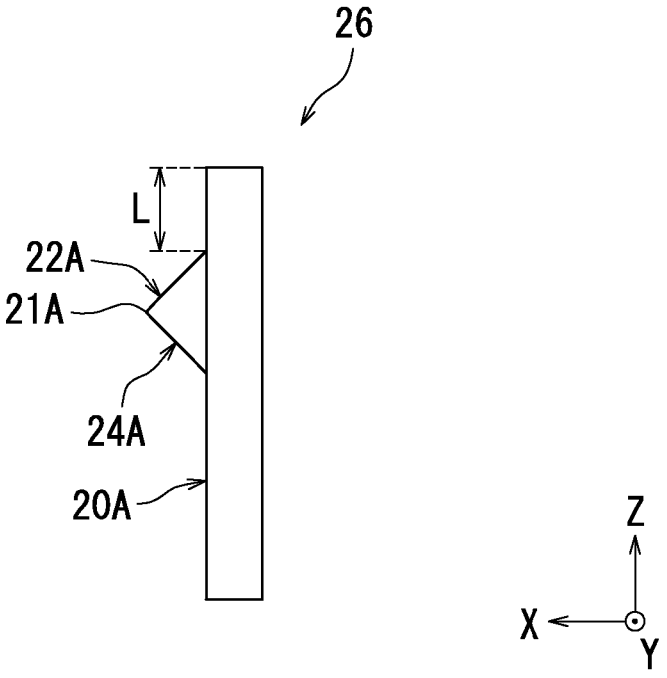
FIG. 11B is a side view of the wiper blade according to the second embodiment.
Figure 12A:
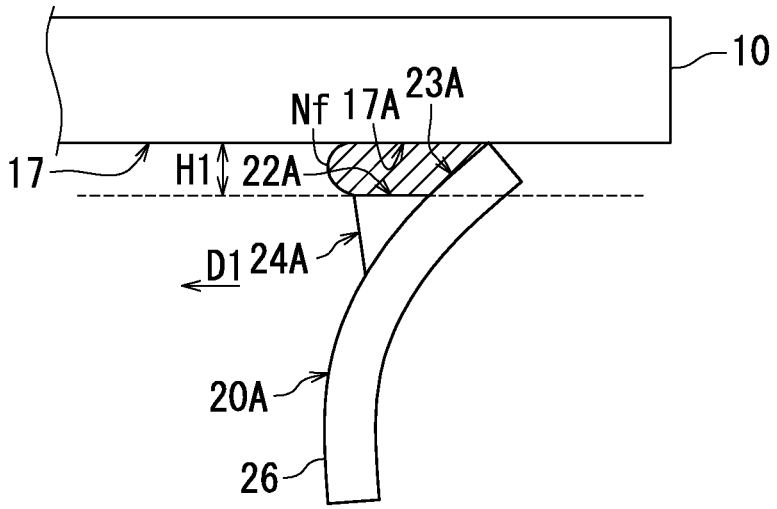
FIG. 12A is a diagram illustrating a shape of the wiper blade in contact with an ink discharge surface and bent in the second embodiment.
Figure 12B:
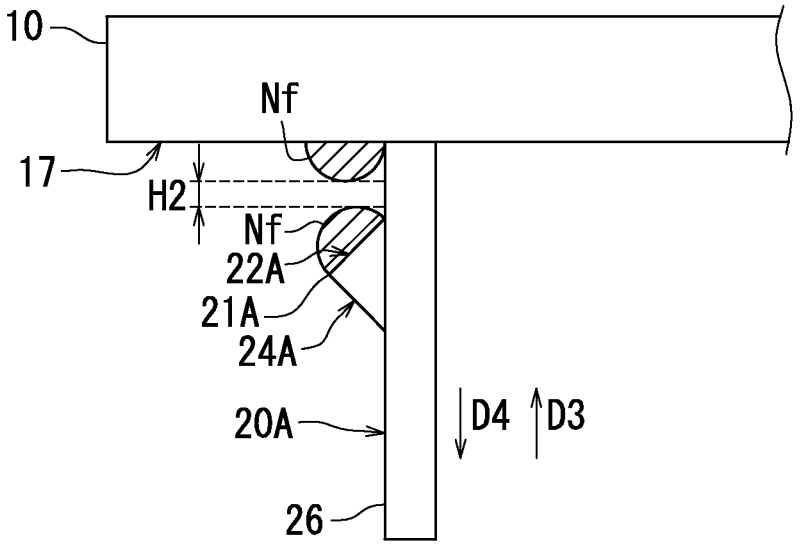
FIG. 12B is a diagram illustrating a shape of the wiper blade in contact with the ink discharge surface and not bent in the second embodiment.

FIG. 11A is a front view of the wiper blade 26. FIG. 11B is a side view of the wiper blade 26. FIG. 12A illustrates the wiper blade 26 pushed against the ink discharge surface 17 so as to be bent. FIG. 12B illustrates the wiper blade 26 in contact with the ink discharge surface 17 so as not to be bent.

As illustrated in FIG. 11A, the wiper blade 26 is, for example, in a flat plate-like shape and has a flat upper end part (an end part that is pushed against the ink discharge surface 17). The back-and-forth direction where the wiper blade 26 is viewed from the front is a direction of the X axis, that is, the wiping directions. A front surface 20A (a carrying surface) of the wiper blade 26 is perpendicular to the wiping directions. The wiping directions are coincident with the longitudinal direction of the ink discharge surface 17. The direction perpendicular to the wiping directions is coincident with the short direction of the ink discharge surface 17.

The wiper blade 26 is elastic. The wiper blade 26 may be an elastic member and, more specifically, may be made from, for example, synthetic rubber or synthetic resin. As illustrated in FIG. 12A, the wiper blade 26 is pushed against the ink discharge surface 17 so as to be bent while wiping ink off the ink discharge surface 17.

The front surface 20A of the wiper blade 26 carries ink on the ink discharge surface 17 when the wiper blade 26 moves in the first wiping direction D1. In the second embodiment, the wiper blade 26 has on the front surface 20A, a front protrusion 21A protruding in the first wiping direction D1. The front protrusion 21A is integral with the wiper blade 26, for example. The front protrusion 21A extends in the short direction of the ink discharge surface 17.

The front protrusion 21A has a front ink retaining surface 22A (an ink retaining surface) and a front ink releasing surface 24A (an ink releasing surface). The front ink retaining surface 22A is connected to the front surface 20A in an inclined manner at a predetermined angle (e.g., 45 degrees) relative to the front surface 20A. The front ink retaining surface 22A faces the ink discharge surface 17 at a predetermined distance H1 in the first wiping state. The predetermined distance H1 may be equal across all regions of the front ink retaining surface 22A or differ in different regions of the front ink retaining surface 22A. In the second embodiment, the predetermined distance H1 is almost equal across all regions of the front ink retaining surface 22A. In other words, the front ink retaining surface 22A is substantially parallel to the ink discharge surface 17 in the first wiping state.

In the above configuration, a pocket that can retain ink on the ink discharge surface 17, especially fresh ink Nf, is contoured by the front ink retaining surface 22A, a front confronting region 17A of the ink discharge surface 17 that faces the front ink retaining surface 22A, and a partial region 23A of the front surface 20A. The partial region 23A of the front surface 20A herein is a region of the front surface 20A ranging from a point in contact with the ink discharge surface 17 to a point connected to the front ink retaining surface 22A. In the above configuration, the wiper blade 26 can carry more fresh ink Nf in wiping in the first wiping direction D1 than a configuration without the front ink retaining surface 22A. Note that the larger the area of the front ink retaining surface 22A is, the more fresh ink Nf the wiper blade 26 can carry.

The predetermined distance H1 is a distance, for example, within which ink on the front confronting region 17A, especially fresh ink Nf, comes into contact with the front ink retaining surface 22A. In other words, the predetermined distance H1 does not exceed a limit height of a first liquid column of fresh ink Nf formed due to surface tension, beyond which the first liquid column separates into ink on the front confronting region 17A and ink on the front ink retaining surface 22A. The first liquid column is a liquid column formed between the front confronting region 17A and the front ink retaining surface 22A in the first wiping state.

The greater the predetermined distance H1 is, the more fresh ink Nf the wiper blade 26 can carry. While on the other hand, when the predetermined distance H1 exceeds the limit height, advantages obtained by providing the front ink retaining surface 22A, that is, an increase in amount of carried fresh ink Nf may be hardly obtained. For this reason, the predetermined distance H1 is preferably determined to be proximate to the limit height. Note that the limit height depends on a material and the like of the fresh ink Nf.

Further, the front ink retaining surface 22A is connected to the front surface 20A at a location a length L apart from an upper end of the wiper blade 26. Specifically, as illustrated in FIG. 12B, the front ink retaining surface 22A in a state in which the wiper blade 26 is in contact with the ink discharge surface 17 so as not to be bent is located such that fresh ink Nf carried by the wiper blade 26 separates into fresh ink Nf on the front ink retaining surface 22A and fresh ink Nf on the ink discharge surface 17. In the second embodiment, fresh ink Nf on the front ink retaining surface 22A is present a predetermined distance H2 apart from ink on the ink discharge surface 17. Accordingly, the length L is set so as to exceed a limit for length (hereinafter referred to as a limit length) beyond which a second liquid column of fresh ink Nf formed due to surface tension separates into ink on the ink discharge surface 17 and ink on the front ink retaining surface 22A. Note that the limit length depends on a material and the like of the fresh ink Nf. The second liquid column is a liquid column formed between the ink discharge surface 17 and the front ink retaining surface 22A in a state in which the wiper blade 26 is in contact with the ink discharge surface 17 so as not to be bent.

In the above configuration, ink can be prevented from being attached to the upper end part of the wiper blade 26 when the wiper blade 26 moves in the descending direction D4 in contrast to a configuration in which the second liquid column does not separate into ink on the ink discharge surface 17 and ink on the front ink retaining surface 22A. When the wiper blade 26 moves in the ascending direction D3 and is pushed against the ink discharge surface 17 again, unwanted ink tends to be attached to the ink discharge surface 17. However, the above configuration can prevent such a situation.

The greater the length L than the limit length is, the more the second liquid column tends to separate. When the length L is further greater than the limit length, the predetermined distance H1 exceeds the limit height. That is, when the length L is further greater than the limit length, the first liquid column separates into ink on the front confronting region 17A and ink on the front ink retaining surface 22A. In view of the foregoing, the length L is set so as to exceed the limit length and so that the predetermined distance H1 does not exceed the limit height.

The front ink releasing surface 24A is inclined at a predetermined angle (e.g., 45 degrees) relative to the front surface 20A and is connected to the front surface 20A and the front ink retaining surface 22A (an end part of the front ink retaining surface 22A on a protruding side). In the configuration with the front ink releasing surface 24A, ink accumulated on the front ink retaining surface 22A can tend to flow downward off the wiper blade 26 by flowing along the front ink releasing surface 24A after wiping. Thus, a situation in which ink is accumulated on and adheres strongly to the front ink retaining surface 22A can be prevented.

As has been described with reference to FIGS. 9-12B, in the second embodiment, the amount of fresh ink Nf carried in cleaning the ink discharge surface 17 can be increased and unwanted ink can be prevented from being attached to the ink discharge surface 17 after cleaning. More specific description will be made below.

The front ink retaining surface 22A faces the ink discharge surface 17 at the predetermined distance H1 while the wiper blade 26 wipes ink off the ink discharge surface 17. In the configuration as above, the wiper blade 26 can carry more fresh ink Nf than a configuration without the front ink retaining surface 22A. In addition, the front ink retaining surface 22A is disposed such that fresh ink Nf on the front ink retaining surface 22A separates from fresh ink Nf on the ink discharge surface 17 in a state in which the wiper blade 26 is in contact with the ink discharge surface 17 so as not to be bent. In the above configuration, ink can be prevented from being attached to the upper end part of the wiper blade 26 when the wiper blade 26 cleans the ink discharge surface 17 and then moves downward from the ink discharge surface 17. As a result, a situation in which ink attached to the upper end part of the wiper blade 26 is attached to the ink discharge surface 17 can be prevented in re-cleaning the ink discharge surface 17 in which the wiper blade 26 is pushed against the ink discharge surface 17.

Further, in the second embodiment, the wiper blade 26 includes on the front surface 20A, the front protrusion 21A having the front ink retaining surface 22A. In the above configuration, the amount of fresh ink Nf carried by the wiper blade 26 in cleaning the ink discharge surface 17 can be increased. As a result, even in a situation in which residual ink Nv is attached to a location apart from a region where fresh ink Nf is released (a central part where the plurality of nozzles 11 are disposed), a sufficient amount of fresh ink Nf can be carried to a location where the residual ink Nv is attached, thereby decreasing the viscosity of the residual ink Nv. Thus, the residual ink Nv can be cleanly removed from the ink discharge surface 17.

Figure 13A:
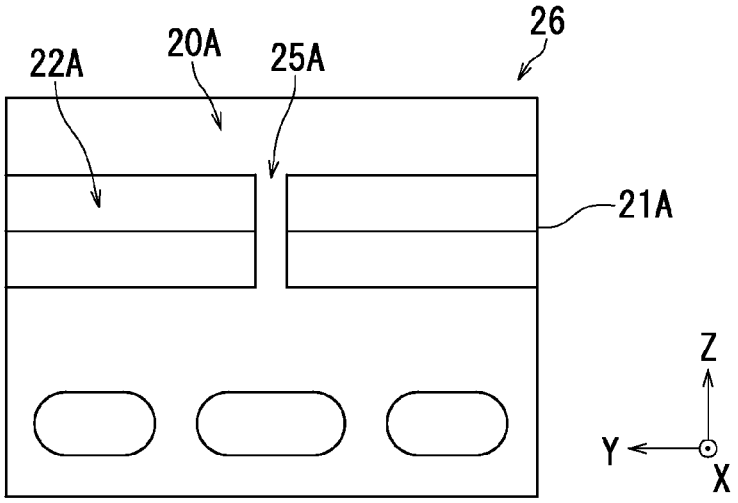
FIG. 13A is a front view of a wiper blade according to a first variation of the second embodiment.
Figure 13B:
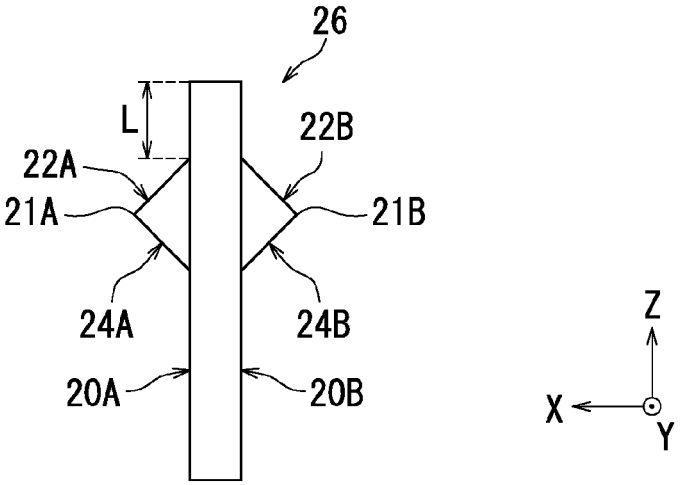
FIG. 13B is a side view of a wiper blade according to a second variation of the second embodiment.
Figure 13C:
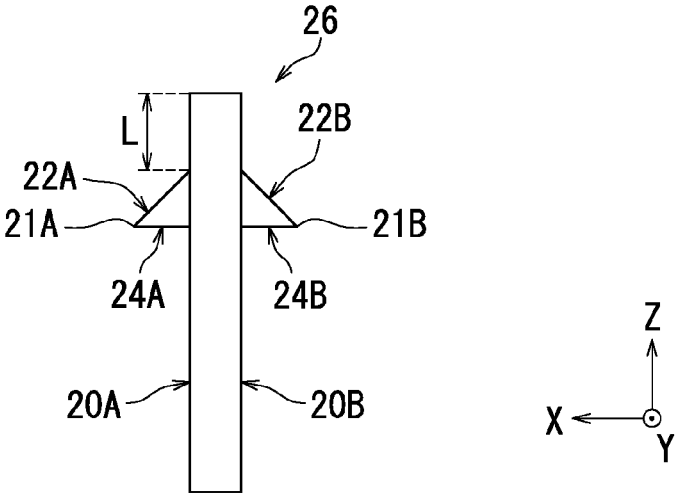
FIG. 13C is a side view of a wiper blade according to a third variation of the second embodiment.

Wiper blades 26 according to first to third variations of the second embodiment will be described with reference to FIGS. 13A-13C. The wiper blades 26 according to the first to third variations of the second embodiment will be described mainly with the focus placed upon the difference from the wiper blade 26 according to the second embodiment.

The first variation of the second embodiment will be described first. FIG. 13A illustrates an example of the wiper blade 26 according to the first variation of the second embodiment. A front protrusion 21A of the wiper blade 26 according to the first variation of the second embodiment has a groove (hereinafter referred to as a front groove 25A). The front groove 25A extends in a direction intersecting the short direction of an ink discharge surface 17. In the present variation, the front groove 25A extends in a direction perpendicular to a direction in which the front protrusion 21A extends, that is, the direction perpendicular to the short direction of the ink discharge surface 17. However, the front groove 25A may not extend in the direction perpendicular to the direction in which the front protrusion 21A extends. It is only required that the front groove 25A extends in a direction intersecting the short direction of the ink discharge surface 17.

The front protrusion 21A has the front groove 25A in the first variation of the second embodiment. In the above configuration, ink accumulated on the front ink retaining surface 22A may tend to flow downward off the wiper blade 26 by flowing along the front groove 25A after wiping. Thus, a situation in which ink accumulates on and adheres strongly to the front ink retaining surface 22A can be prevented.

The second variation of the second embodiment will be described next. FIG. 13B illustrates an example of the wiper blade 26 according to the second variation of the second embodiment. The wiper blade 26 according to the second variation includes on a rear surface 20B, a rear protrusion 21B protruding in the second wiping direction D2 opposite to the first wiping direction D1. The rear protrusion 21B has a rear ink retaining surface 22B and a rear ink releasing surface 24B. The wiper blade 26 in the second variation carries ink on the ink discharge surface 17 in moving in the second wiping direction D2 opposite to the first wiping direction D1. The rear ink retaining surface 22B has the same configuration and advantages as the aforementioned front ink retaining surface 22A. The rear ink releasing surface 24B has the same configuration and advantages as the aforementioned front ink releasing surface 24A.

The wiper blade 26 according to the second variation of the second embodiment includes the rear protrusion 21B protruding in the second wiping direction D2 opposite to the first wiping direction D1. In the above configuration, the wiper blade 26 can also clean the ink discharge surface 17 in the direction opposite to the first wiping direction D1. As a result, the ink discharge surface 17 can be cleaned more effectively than a configuration in which the wiper blade 26 performs wiping only in one direction.

The third variation of the second embodiment will be described next. FIG. 13C illustrates an example of the wiper blade 26 according to the third variation of the second embodiment. The wiper blade 26 according to the third variation has a front ink releasing surface 24A connected to a front surface 20A substantially perpendicularly. In the above configuration, a member that constitutes a front protrusion 21A can be reduced in size when compared with a configuration in which the front ink releasing surface 24A is connected to the front surface 20A in an inclined manner at a predetermined angle greater than a right angle. As a result, manufacturing cost of the wiper blade 26 can be reduced. In a configuration in which the wiper blade 26 includes a rear protrusion 21B, a rear ink releasing surface 24B is connected likewise to the rear surface 20B substantially perpendicularly.

Although the embodiments and variations of the present disclosure have been described above, the present disclosure is not limited to the above embodiments and variations. Various alterations can be made within the scope not departing from the subject matter of the present disclosure (see (1)-(5) below, for example). The drawings are schematic illustrations that emphasize elements of configuration in order to facilitate understanding thereof. Therefore, properties of each of the illustrated elements, such as thickness, length, and number thereof, may differ from actual properties of the element. The properties of each of the elements, such as shape and dimension thereof described above are mere examples and not limited specifically. A wide range of variations of the properties can be made to the embodiments so long as such variations do not deviate from the intended scope of the advantages in the present disclosure.

(1) For example, the respective protrusions (the front and rear protrusions 21A and 21B) are disposed on the front and rear surfaces 20A and 20B in the first embodiment. However, a protrusion may be disposed on either one of the front and rear surfaces 20A and 20B. For example, in a configuration in which wiping is performed only in the first wiping direction D1, only the front protrusion 21A may be disposed.

(2) The ink retaining surfaces (the front and rear ink retaining surfaces 22A and 22B) in the first embodiment are substantially parallel to the ink discharge surface 17 when the wiper blade 20 is bent, which however should not be taken to limit the present disclosure. The ink retaining surfaces may be slightly inclined relative to the ink discharge surface 17 when the wiper blade 20 is bent, for example.

(3) The recording medium is paper P in the first embodiment, which however should not be taken to limit the present disclosure. The recording medium may be any other medium on which the recording head 10 can form an image, such as an envelope or fabric.

(4) As described with reference to FIG. 13A, the front protrusion 21A has a single front groove 25A in the first variation of the second embodiment. However, the front protrusion 21A may have a plurality of front grooves 25A.

(5) As described with reference to FIG. 13A, the front protrusion 21A has the front groove 25A in the first variation of the second embodiment. However, in a configuration in which the wiper blade 26 includes the rear protrusion 21B, the rear protrusion 21B may have a rear groove.

What is claimed is:

1. An inkjet recording apparatus comprising:

a recording head having an ink discharge surface and configured to discharge ink onto a recording medium;

a wiper blade configured to clean the ink discharge surface of the recording head; and a controller configured to cause the wiper blade to wipe ink off the ink discharge surface by causing the wiper blade to be pushed against the ink discharge surface and move in a predetermined movement direction, wherein the wiper blade includes a protrusion protruding in the predetermined movement direction, the protrusion has an ink retaining surface that faces the ink discharge surface while the wiper blade wipes ink off the ink discharge surface, the ink retaining surface is located apart from the ink discharge surface at a first predetermined distance during the wiper blade wiping ink on the ink discharge surface, and in contact with a front surface of the wiper blade at a second predetermined distance from an upper end of the wiper blade while the wiper blade is in contact with the ink discharge surface so as not to be bent, the front surface of the wiper blade moves the ink on the ink discharge surface while the wiper blade moves in the movement direction, and the protrusion has a groove extending in a direction perpendicular to a short direction of the ink discharge surface.

2. The inkjet recording apparatus according to claim 1, wherein ink on the ink discharge surface includes a first ink that is thickened and a second ink that is not thickened, and the controller causes the wiper blade to wipe ink off the ink discharge surface after controlling the recording head to release the second ink onto the ink discharge surface.

3. The inkjet recording apparatus according to claim 1, wherein during the time when the wiper blade wipes ink off the ink discharge surface, the ink retaining surface is substantially parallel to the ink discharge surface.

4. The inkjet recording apparatus according to claim 1, wherein the first predetermined distance is a distance in which ink on a region of the ink discharge surface comes into contact with the ink retaining surface, the region of the ink discharge surface facing the ink retaining surface when the wiper blade wipes ink off the ink discharge surface.

5. The inkjet recording apparatus according to claim 1, wherein the wiper blade is elastic, and the wiper blade is bent while being pushed against the ink discharge surface.

6. The inkjet recording apparatus according to claim 1, wherein the predetermined movement direction includes a first movement direction and a second movement direction opposite to the first movement direction, the wiper blade includes:

a first carrying surface that is perpendicular to the predetermined movement direction and that carries ink on the ink discharge surface when the wiper blade moves in the first movement direction;

a second carrying surface that is perpendicular to the predetermined movement direction and that carries ink on the ink discharge surface when the wiper blade moves in the second movement direction, a first protrusion disposed on the first carrying surface and protruding in the first movement direction; and a second protrusion disposed on the second carrying surface and protruding in the second movement direction, the first protrusion has a first ink retaining surface that faces the ink discharge surface at a predetermined distance while the wiper blade moves in the first movement direction to wipe ink off the ink discharge surface while, and the second protrusion has a second ink retaining surface that faces the ink discharge surface at a predetermined distance while the wiper blade moves in the second movement direction to wipe ink off the ink discharge surface.

7. An inkjet recording apparatus comprising:

a recording head having an ink discharge surface and configured to discharge ink onto a recording medium;

a wiper blade configured to clean the ink discharge surface of the recording head; and a controller configured to cause the wiper blade to wipe ink off the ink discharge surface by causing the wiper blade to be pushed against the ink discharge surface and move in a predetermined movement direction, wherein the wiper blade has a protrusion protruding in the predetermined movement direction and a carrying surface that carries ink on the ink discharge surface, the protrusion is disposed on the carrying surface, and the protrusion has an ink retaining surface that faces the ink discharge surface at a predetermined distance while the wiper blade wipes ink off the ink discharge surface and an ink releasing surface that is inclined at a predetermined angle relative to the carrying surface and that is connected to the ink retaining surface and the carrying surface.

8. The inkjet recording apparatus according to claim 7, wherein ink on the ink discharge surface includes a first ink that is thickened and a second ink that is not thickened, and the controller causes the wiper blade to wipe ink off the ink discharge surface after controlling the recording head to release the second ink onto the ink discharge surface.

9. The inkjet recording apparatus according to claim 7, wherein during the time when the wiper blade wipes ink off the ink discharge surface, the ink retaining surface is substantially parallel to the ink discharge surface.

10. The inkjet recording apparatus according to claim 7, wherein the predetermined distance is a distance in which ink on a region of the ink discharge surface comes into contact with the ink retaining surface, the region of the ink discharge surface facing the ink retaining surface when the wiper blade wipes ink off the ink discharge surface.

11. The inkjet recording apparatus according to claim 7, wherein the wiper blade is elastic, and the wiper blade is bent while being pushed against the ink discharge surface.

12. The inkjet recording apparatus according to claim 7, wherein the predetermined movement direction includes a first movement direction and a second movement direction opposite to the first movement direction, the wiper blade includes:

a first carrying surface that is perpendicular to the predetermined movement direction and that carries ink on the ink discharge surface when the wiper blade moves in the first movement direction;

a second carrying surface that is perpendicular to the predetermined movement direction and that carries ink on the ink discharge surface when the wiper blade moves in the second movement direction, a first protrusion disposed on the first carrying surface and protruding in the first movement direction; and a second protrusion disposed on the second carrying surface and protruding in the second movement direction, the first protrusion has a first ink retaining surface that faces the ink discharge surface at a predetermined distance while the wiper blade moves in the first movement direction to wipe ink off the ink discharge surface while, and the second protrusion has a second ink retaining surface that faces the ink discharge surface at a predetermined distance while the wiper blade moves in the second movement direction to wipe ink off the ink discharge surface.

13. The inkjet recording apparatus according to claim 7, wherein the protrusion has a groove extending in a direction perpendicular to a short direction of the ink discharge surface.

14. An inkjet recording apparatus comprising:

a recording head having an ink discharge surface and configured to discharge ink onto a recording medium;

a wiper blade configured to clean the ink discharge surface of the recording head; and a controller configured to cause the wiper blade to wipe ink off the ink discharge surface by causing the wiper blade to be pushed against the ink discharge surface and move in a predetermined movement direction, wherein the wiper blade includes a protrusion protruding in the predetermined movement direction, the protrusion has an ink retaining surface that faces the ink discharge surface at a predetermined distance while the wiper blade wipes ink off the ink discharge surface, the controller causes the wiper blade to be pushed against the ink discharge surface so that the wiper blade is bent, and in a state in which the wiper blade is in contact with the ink discharge surface so as not to be bent, the ink retaining surface is positioned such that ink on the ink retaining surface separates from ink on the ink discharge surface.

15. The inkjet recording apparatus according to claim 14, wherein ink on the ink discharge surface includes a first ink that is thickened and a second ink that is not thickened, and the controller causes the wiper blade to wipe ink off the ink discharge surface after controlling the recording head to release the second ink onto the ink discharge surface.

16. The inkjet recording apparatus according to claim 14, wherein during the time when the wiper blade wipes ink off the ink discharge surface, the ink retaining surface is substantially parallel to the ink discharge surface.

17. The inkjet recording apparatus according to claim 14, wherein the predetermined distance is a distance in which ink on a region of the ink discharge surface comes into contact with the ink retaining surface, the region of the ink discharge surface facing the ink retaining surface when the wiper blade wipes ink off the ink discharge surface.

18. The inkjet recording apparatus according to claim 14, wherein the wiper blade is elastic, and the wiper blade is bent while being pushed against the ink discharge surface.

19. The inkjet recording apparatus according to claim 14, wherein the predetermined movement direction includes a first movement direction and a second movement direction opposite to the first movement direction, the wiper blade includes:

a first carrying surface that is perpendicular to the predetermined movement direction and that carries ink on the ink discharge surface when the wiper blade moves in the first movement direction;

a second carrying surface that is perpendicular to the predetermined movement direction and that carries ink on the ink discharge surface when the wiper blade moves in the second movement direction, a first protrusion disposed on the first carrying surface and protruding in the first movement direction; and a second protrusion disposed on the second carrying surface and protruding in the second movement direction, the first protrusion has a first ink retaining surface that faces the ink discharge surface at a predetermined distance while the wiper blade moves in the first movement direction to wipe ink off the ink discharge surface while, and the second protrusion has a second ink retaining surface that faces the ink discharge surface at a predetermined distance while the wiper blade moves in the second movement direction to wipe ink off the ink discharge surface.

* * * * *